US005460630A

United States Patent [19]

Ouziel et al.

[11] Patent Number: 5,460,630

[45] Date of Patent: Oct. 24, 1995

[54] PROCESS FOR DYEING FIBROUS MATERIALS MADE OF OR CONTAINING WOOL

[75] Inventors: Philippe Ouziel, Altkirch, France; Martin Kuhn, Dornach, Switzerland

[73] Assignee: Ciba-Geigy Corporation, Ardsley, N.Y.

[21] Appl. No.: 278,596

[22] Filed: Jul. 21, 1994

[30] Foreign Application Priority Data

Jul. 28, 1993 [CH] Switzerland ..... 2282/93

[51] Int. Cl.[6] ..... D06P 1/39; D06P 5/00; D06P 3/16; D06P 3/852

[52] U.S. Cl. ..... 8/490; 8/533; 8/552; 8/561; 8/609; 8/611; 8/614; 8/594; 8/598; 8/576; 8/673; 8/680; 8/128.1

[58] Field of Search ..... 8/490, 917, 128.1, 8/552, 561, 576, 594, 598, 609, 611, 612, 614, 615, 673, 680, 533

[56] References Cited

U.S. PATENT DOCUMENTS 5,145,486 9/1992 Hannemann ..... 8/543
5,356,442 10/1994 Ouziel et al. ..... 8/552

*Primary Examiner*—Margaret Einsmann
*Attorney, Agent, or Firm*—George R. Dohmann

[57] ABSTRACT

Described is a process for dyeing fibrous materials made of or containing wool with anionic dyes, which comprises dyeing these materials in the presence of a wool preservative comprising at least one compound of the formula $$R—O—CH_2—CH(OH)—CH_2—Y \quad (1),$$

where the variables are each as defined in the claims. The process makes available rub-fast level dyeings without deterioration in the quality of the wool.

11 Claims, No Drawings

PROCESS FOR DYEING FIBROUS MATERIALS MADE OF OR CONTAINING WOOL

The present invention relates to a novel process for the high temperature dyeing of wool or fibrous materials containing wool.

It is known to dye wool or fibrous materials containing wool in the presence of assistants in order in this way to counteract fibre damage which arises in particular in high temperature dyeing. Many of the known assistants contain formaldehyde or release formaldehyde on heating, which is toxicologically undesirable.

There has now been surprisingly found an improved process for the high temperature dyeing of fibrous materials made of or containing wool that is based on the use of a novel class of wool preservatives.

The present invention accordingly provides a process for dyeing fibrous materials made of or containing wool with anionic dyes, which comprises dyeing these materials in the presence of a wool preservative comprising at least one compound of the formula $$R—O—CH_2—CH(OH)—CH_2—Y \quad (1),$$

where Y is halogen and R is (a) the radical of a hydroxyl-containing ethylenically unsaturated compound, (b) the radical of a homo- or copolymer of hydroxyl-containing ethylenically unsaturated monomers with or without one or more comonomers, (c) the radical of a mono-, di-, tri-, oligo- or polysaccharide, (d) the radical of a hydroxyl-containing $C_1$–$C_{22}$alkyl compound, (e) the radical of a polyglycerol derivative having a molecular weight ≦50,000, or (f) the radical of a polyglycol.

Y is for example bromine or preferably chlorine.

When the abovementioned radicals (a) to (f) contain further hydroxyl groups, these can each be present in the form of a free hydroxyl group or, for example, in the form of an ether grouping of the formula $$—O—CH_2—CH(OH)—CH_2—Y \quad (2),$$

where Y is as defined above. Further hydroxyl groups present in the radical R may also be present in ethoxylated, propoxylated or 2-hydroxypropoxylated form, for example in the form of a radical of the formula $$—O—(CH_2CH_{20})_x—H \quad (3)$$

$$—O—(CH_2CH[CH_3]O)_y—H \quad (4)$$

or $$—O—(CH_2CH[OH]CH_2O)_z—H \quad (5),$$

where x, y and z are each independently of the others a number from, for example, 1 to 200.

When R is the radical of a hydroxyl-containing ethylenically unsaturated compound as per (a), it is for example the radical of allyl alcohol or the radical of an ethylenically unsaturated mono-, di- or tricarboxylic acid wholly esterified with a hydroxy-$C_1$–$C_4$alkyl compound or with a $C_2$–$C_4$alkylene glycol. Examples of such ethylenically unsaturated hydroxyalkyl carboxylates are the 2- or 3-hydroxypropyl esters or hydroxyethyl esters, diesters or triesters of (meth)acrylic acid, maleic acid, fumaric acid, itaconic acid, mesaconic acid, citraconic acid, vinylacetic acid, vinylpropionic acid, crotonic acid, aconitic acid, allylacetic acid, vinyloxyacetic acid, allyloxyacetic acid, α,β-dimethyl(meth)acrylic acid, methylenemalonic acid, 2-hydroxy(meth)acrylic acid, 2-halo(meth)acrylic acid, α-carboxyethyl acrylate, acrylamidoglycolic acid, β-carboxyethyl acrylate, allyloxy-3-hydroxybutanoic acid, allyloxymalonic acid, allylsuccinic acid or allylmalonic acid.

A hydroxyl-containing ethylenically unsaturated radical R is preferably the radical of allyl alcohol, hydroxypropyl or hydroxyethyl acrylate, hydroxypropyl or hydroxyethyl methacrylate or dihydroxypropyl or dihydroxyethyl maleate.

When R is the radical of a homo- or copolymer as per (b), it is for example the radical of a homo- or copolymer formed from one or more of the aforementioned hydroxyl-containing α,β-unsaturated compounds with or without one or more copolymerizable monoethylenically unsaturated monomers.

Suitable copolymerizable monoethylenically unsaturated monomers include for example esters, amides or nitriles of unsaturated carboxylic acids, e.g. methyl acrylate, ethyl acrylate, methyl methacrylate, ethyl methacrylate, hydroxyethyl (meth)acrylate, hydroxypropyl (meth)acrylates, hydroxybutyl (meth)acrylates, dimethylaminoethyl (meth-)acrylate, diethylaminoethyl (meth)acrylate, acrylamide, methacrylamide, N-alkyl(meth)acrylamides, acrylonitrile or methacrylonitrile. A further group of suitable comonomers includes sulfoo or phosphono-containing monomers, e.g. (meth)allylsulfonic acid, vinylsulfonic acid, 3-allyloxy-2-hydroxypropanesulfonic acid, styrenesulfonic acid, acrylamidomethanesulfonic acid, 3-sulfopropyl (meth)acrylates, 3-sulfopropyl itaconates, 2-acrylamido-2-methylpropanesulfonic acid, vinyl phosphonate, allyl phosphonate and acrylamidomethylpropanephosphonic acid. Also suitable for use as monomers are N-vinylpyrrolidone, N-vinylcaprolactam, N-vinylformamide, N-vinyl-N-methylformamide, Novinylacetamide, N-vinyl-N-methylacetamide, N-vinylimidazole, N-vinylmethylimidazole, N-vinyl-2-methylimidazole, N-vinylimidazoline, methyl vinyl ketone, vinyl acetate, vinyl propionate, vinyl butyrate, styrene, olefins having for example 2 to 10 carbon atoms, such as ethylene, propylene, isobutylene, hexene, diisobutene and vinyl alkyl ethers such as methyl vinyl ether, ethyl vinyl ether, dimethoxyethylene, n-butyl vinyl ether, isobutyl vinyl ether, hexyl vinyl ether or octyl vinyl ether, and also mixtures thereof.

The parent homo- and copolymers of R preferably have a molecular weight of for example 100 to 1,000,000, particularly preferably from 100 to 10,000 and especially preferably from 500 to 5,000.

When R is the radical of a mono-, di-, tri-, oligo- or polysaccharide as per (c), it can be any customary saccharide as known from the textbooks of organic chemistry. Examples of such saccharides are monosaccharides such as pentoses, e.g. arabinose, xylose or ribose, or hexoses, e.g. glucose, mannose, galactose or fructose, di-, tri- and oligosaccharides, e.g. sucrose, milk sugar, lactose, maltose or raffinose, or polysaccharides, e.g. starch or cellulose. R is preferably the radical of starch whose hydroxyl groups are partly or wholly present in the form of an ether of the previously indicated formula (2).

When R is the radical of a hydroxyl-containing $C_1$–$C_{22}$alkyl compound as per (d), it is for example the radical of a monohydric alkanol, e.g. the radical of methanol, ethanol, n-propanol, isopropanol, n-butanol, isobutanol, sec-butanol or tert-butanol, or the radical of a straight-chain or branched $C_5$–$C_{22}$monoalcohol, the radical of a glycol, e.g. ethylene glycol or propylene glycol, or the radical of a polyhydric alcohol, e.g. glycerol, diglycerol, triglycerol, 1,1,1-tris(hydroxymethyl)propane, erythritol, pentaerythritol, arabitol, sorbitol or mannitol. If the alcohols mentioned have more than one hydroxyl group, the further hydroxyl groups can be present partly or wholly in the form of an ether of the previously indicated formula (2) or in the form of an ethoxylated, propoxylated, or 2-hydroxypropoxylated radical of the formula (3), (4) or (5).

A hydroxyl-containing alkyl radical R is preferably the radical of a polyhydric alcohol whose hydroxyl groups are partly or wholly present in the form of an ether of the previously indicated formula (2) or in the form of an ethoxylated, propoxylated or 2-hydroxypropoxylated radical of the formula (3), (4) or (5). Examples of particularly preferred hydroxyalkyl radicals R are the radical of glycerol, diglycerol, pentaerythritol and 1,1,1-tris(hydroxymethyl-)propane wherein the further hydroxyl groups are present partly or wholly in the form of an ether of the previously indicated formula (2) or in the form of an ethoxylated, propoxylated or 2-hydroxypropoxylated radical of the formula (3), (4) or (5).

When R is the radical of a polyglycerol as per (e), it preferably has a molecular weight ≦5000. The hydroxyl groups of the polyglycerol are preferably present partly or wholly in the form of an ether of the previously indicated formula (2).

When R is the radical of a polyglycol as per (f), it conforms for example to the formula $$—(CH_2CH_2O)_s'(CH_2CH[CH_3]O)_t—H \quad (6),$$

where s and t are each independently of the other a number from for example 0 to 200 and the sum (s+t)≧1.

The polyglycol has for example a molecular weight of ≦100,000 and preferably ≦1,000. Particularly preferably a polyglycol radical R is the radical of a polyethylene glycol having a molecular weight of ≦1,000.

The compounds of the formula (1) used according to the invention can be prepared in a manner known per se, for example by reacting a compound of the formula $$R—OH \quad (7),$$

where R is as defined above, with an epihalohydrin, preferably epibromohydrin or particularly preferably epichlorohydrin, in the presence or absence of a catalyst, e.g. boron trifluoride/diacetic acid, boron trifluoride-ethyl etherate, $SnCl_4$ or $Zn(BF_4)_2$. The compounds of the formula (7) are known per se or can be obtained by methods known per se.

The wool preservatives used according to the invention may contain one or more of the compounds of the formula (1). Good results are also obtained on using a wool preservative comprising a mixture comprising (I) one or more compounds of the formula ( 1 ) and (II) an organic mono-, di- or tricarboxylic acid, e.g. acetic acid, propionic acid, succinic acid, isoserinediacetic acid, nitriloacetic acid, ethylenediaminetriacetic acid, diethylenetfiaminepentaacetic acid, hydroxyethylenediaminotriacetic acid, malic acid, citric acid, hydroxycitric acid, lactic acid, tartronic acid or tartaric acid, or a mineral acid, e.g. hydrochloric acid, sulfuric acid, phosphoric acid.

Preferred embodiments of the present invention concern the use of a wool preservative comprising a compound of the formula (1) where Y is chlorine and R is the radical of a mono-, di-, tri-, oligo- or polysaccharide, the radical of a hydroxyl-containing $C_1$–$C_{22}$alkyl compound, the radical of a polyglycerol derivative having a molecular weight ≦50,000, or the radical of a polyglycol;

the use of a wool preservative comprising a compound of the formula (1) where Y is chlorine and R is the radical of a mono-, di-, tri-, oligo- or polysaccharide whose hydroxyl groups are partly or wholly present in the form of the ether of the formula $$—O—CH_2—CH(OH)—CH_2—Cl \quad (2a);$$

the use of a wool preservative comprising a compound of the formula (1) where Y is chlorine and R is the radical of a polyhydric alcohol whose hydroxyl groups are partly or wholly present in the form of the ether of the previously indicated formula (2a) or in the form of the ethoxylated, propoxylated or 2-hydroxypropoxylated radical of the previously indicated formula (3), (4) or (5);

the use of a wool preservative comprising a compound of the formula (1) where Y is chlorine and R is the radical of glycerol, diglycerol, pentaerythritol and 1,1,1-tris(hydroxymethyl)propane wherein the further hydroxyl groups are partly or wholly present in the form of an ether of the previously indicated formula (2a) or in the form of the ethoxylated, propoxylated or 2-hydroxypropoxylated radical of the formula (3), (4) or (5);

the use of a wool preservative comprising a compound of the formula (1) where Y is chlorine and R is the radical of a polyethylene glycol having a molecular weight ≦1,000.

The procedure is for example to first pretreat the fibrous material made of or containing wool with the wool preservative in an aqueous bath and then to dye it by adding the dye to this bath. It is also possible to treat the fibrous material with the wool preservative and the dye simultaneously in one and the same aqueous bath.

It has been found to be practicable to use the wool preservative in an amount from for example 0.5 to 10% by weight, preferably from 1 to 6% by weight, on weight of fibre.

The fibrous material in question can be wool alone or a blend of, for example, wool/nylon or wool/polyester. Mixtures of wool and synthetic polyamide are preferably dyed with anionic dyes and mixtures of wool and polyester fibres are preferably dyed with disperse and anionic dyes. Suitable anionic dyes and disperse dyes are known to the person skilled in the art.

The fibrous material can be present in various stages of processing, for example in the form of yam, staple, slubbing, knitted material, bonded fibre web material or preferably woven fabric.

The blends are preferably blends of wool and polyester which generally contain from 20 to 50 parts by weight of wool to 80-50 parts by weight of polyester. The fibre blends preferred for the process contain 45 parts of wool and 55 parts of polyester fibres.

The liquor ratio of the process according to the invention can be varied within wide limits; it can be for example from 1:1 to 100:1, preferably from 10:1 to 50:1.

As well as the dye, water and the wool assistant, the dyebath may contain further customary additaments. Examples are mineral acids, organic acids and/or salts thereof which serve to set the pH of the dyebath, also electrolytes, levelling, wetting and antifoaming agents and also, in the event of a wool/polyester blend being dyed, carriers and/or dispersants.

The dyebath has a pH of for example 4 to 6.5, preferably from 5.2 to 5.8. The process of the invention is generally carried out at a temperature of, for example, 60° to 130° C.

When the material to be dyed is wool alone, the dyeing is advantageously carried out by the exhaust method, for example at a temperature within the range from 60° to 106° C, preferably 95° to 98° C. The dyeing time can vary as a function of the requirements, but is preferably 60–120 minutes. Polyester/wool blends are advantageously dyed in a single bath from an aqueous liquor by the exhaust method. Preference is given to dyeing by the high temperature process in closed, pressure-resistant machines at temperatures above 100° C., advantageously between 110° and 125° C., preferably at 118°–120° C., under atmospheric or superatmospheric pressure.

The fibre blends can also be dyed by the usual carrier method at temperatures below 106° C., for example within the temperature range from 75° to 98° C., in the presence of one or more carriers.

Polyester/wool blends can be dyed by first treating them with the wool preservative with or without the carrier and then dyeing. It is also possible to treat the material simultaneously with the wool preservative, dyes and any assistants. It is preferable to introduce the blend material into a liquor which contains the wool preservative with or without further customary assistants and has a temperature of 40°–50° C., and to treat the material at that temperature for 5 to 15 minutes. Thereafter the temperature is raised to about 60°–70° C., the dye is added, the liquor is slowly heated to the dyeing temperature, and then the dyeing is carried out at that temperature for about 20 to 60, preferably 30 to 45, minutes. At the end the liquor is cooled back down to about 60° C., and the dyed material is worked up in a conventional manner.

The process of the invention makes it possible to dye wool or in particular wool/polyester blends at high temperature without damaging the wool content in any way, i.e. while preserving important, fibre-technological properties of the wool, such as tensile strength, burst resistance and extensibility. It is also to be noted that the polyester content of blend fabrics is free of any yellowing.

The examples which follow illustrate the invention. Parts and percentages are by weight.

Preparation of the wool preservatives

EXAMPLE 1

A sulfonation flask is charged with 33.2 parts of diglycerol (0.8 0H equivalents) and 2.8 g of boron trifluoride/diacetic acid complex and the contents are heated to 75° C. 37 parts of epichlorohydrin are added dropwise over about 2 hours while the temperature is maintained at between 75° and 80° C. This is followed by continued stirring at 75° C. for about 30 minutes, cooling down to room temperature, neutralizing by addition of sodium hydroxide solution to about pH 5, and drying the product under reduced pressure.

EXAMPLE 2

A suitable reaction vessel is charged with 46 parts of glycerol and 1 part of boron trifluoride-ethyl etherate under nitrogen. 148.2 parts of glycidol are added dropwise at from 25° to 30° C. over 5.5 hours and the reaction mixture is then further stirred at 50° C. for about 3 hours and then at room temperature for about 12 to 15 hours. Thereafter 92.5 parts of epichlorohydrin are added dropwise at 25° to 30° C. over about 5.5 hours and the reaction mixture is further stirred at room temperature for about 12 hours and at 50° C. for 3 hours.

To 165.1 parts of the product obtained above are added dropwise a further 53.3 parts of epichlorohydrin over about 3 hours while the temperature is maintained at about 35° to 40° C. The reaction mixture is then heated at about 50° C. for about 4 hours and thereafter dried under reduced pressure.

EXAMPLE 3

38.8 parts of tetraethylene glycol (0.4 OH equivalents) and 2.9 parts of boron trifluoride/diacetic acid complex are heated to 75° C. and 37 parts of epichlorohydrin are added over about 2 hours. This is followed by further stirring at 75° C. for about 30 minutes, cooling down to room temperature, neutralizing to pH 6 and drying the product.

EXAMPLE 4

Example 3 is repeated with 41.2 parts of polyethylene glycol 400 (0.2 OH equivalents), 1.4 parts of boron trifluoride/diacetic acid complex and 18.5 parts epichlorohydrin being reacted.

EXAMPLE 5

27.5 parts of starch, 15 parts of water and 8.4 parts of $Zn(BF_4)_2$ (40% in water) are heated to 80° C. and 64.8 parts epichlorohydrin are added at that temperature over about 6 hours. Thereafter the mixture is stirred at 80° C. for about a further hour, and the product is precipitated in ethanol and dried.

EXAMPLE 6

49.2 parts of starch, 95 parts of dioxane and 11.4 parts of $Zn(BF_4)_2$ (40% in water) are heated to 75° C. and 23.1 parts of epichlorohydrin are added at that temperature over about 2 hours. The batch is further stirred at 75° C. for about 2 hours and cooled down to room temperature, and the product is filtered off and dried.

EXAMPLE 7

Example 3 is repeated with 46.4 parts of hydroxyethyl acrylate (stabilized with 0.3 part of hydroquinone monomethyl ether), 2.9 parts of boron trifluoride/diacetic acid complex and 37 parts of epichlorohydrin being reacted.

EXAMPLE 8

A suitable reaction vessel is charged with 58 parts of maleic acid and 3 parts of triethylamine and the contents are heated to 115° C. 74 parts of glycidol are added dropwise over about 2 hours and the reaction mixture is then further stirred at 115° C. for 2 hours. After cooling down to about 50° C., 4.2 parts of boron trifluoride/ethyl etherate are added and the reaction mixture is heated back up to about 115° C. Then 74 parts of glycidol are added dropwise over about 2 hours and the reaction mixture is then further stirred for about 3 hours. To the reaction mixture are added dropwise 92.5 parts epichlorohydrin over about 2.5 hours while the temperature is maintained at 115° C. The reaction mixture is then held at that temperature for about 9 hours and thereafter dried under reduced pressure.

EXAMPLE 9

Example 3 is repeated with 26.8 parts of 1,1,1-tris(hydroxymethyl)propane, 4.3 parts of boron trifluoride/diacetic acid complex and 55.5 parts epichlorohydrin being reacted with one another.

EXAMPLE 10

277.1 parts of a reaction product of 1 mol of pentaerythritol with 8 mol of glycidol are introduced into a sulfonation flask under nitrogen and 54.7 parts of epichlorohydrin are added at a temperature from 25° to 30° C. over about 4 hours. Thereafter the reaction mixture is further stirred at 50° C. for about 4 hours and then the product is dried under reduced pressure.

Dyeing examples

EXAMPLE 11

100 parts of a woven blend fabric consisting of 55% polyester and 45% wool are pretreated for 5 min at 40° C. in a circulation machine with a liquor containing 1.5 parts of the product of Example 1, 0.5 part of a sulfated fatty amine polyglycol ether, 1.0 part of a commercial assistant mixture (based on carboxyl- and phosphoryl-aromatic compounds) and 2.0 parts of sodium acetate in 1200 parts of water and which has been adjusted to pH 5.5 with acetic acid. The liquor is then heated over 30 minutes to 120° C. with the addition at 70° C. of 2.0 parts of the dye mixture consisting of 1.6% by weight of the dye of the formula

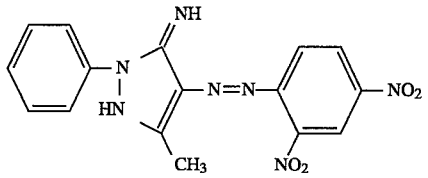

60% by weight of the dye of the formula

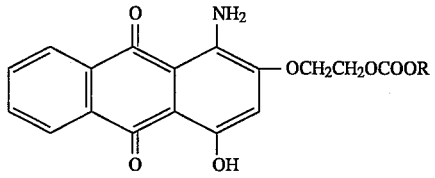

(R = 50% $-CH_2-CH_3$ + 50% $-C_6H_5$)

5.0% by weight of the dye of the formula

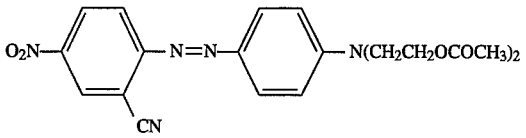

4.0 parts of dye of formula

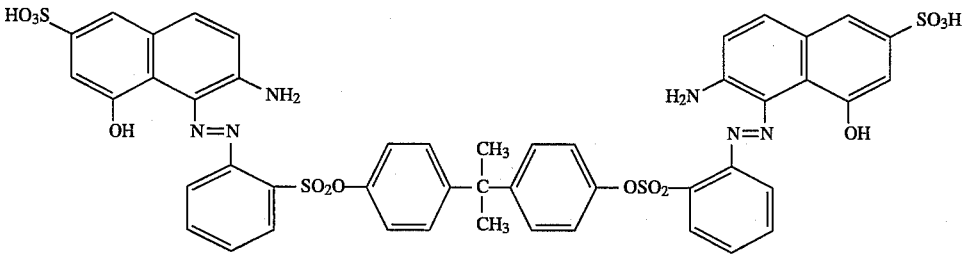

3.3 parts of dye of the formula

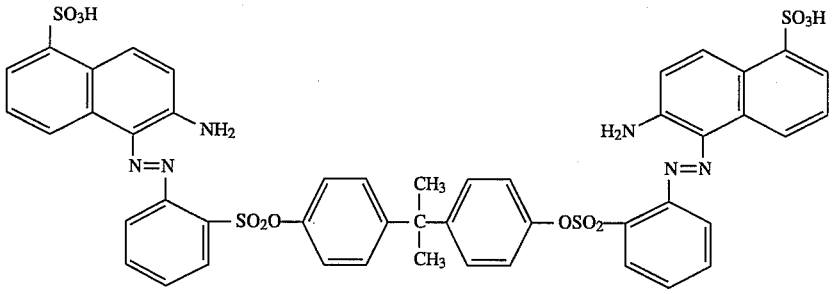

15.0 parts of dye of the formula

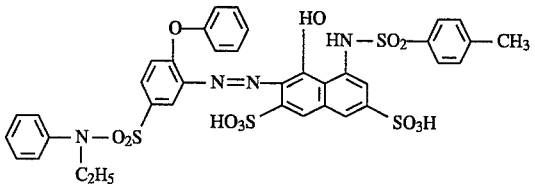

and 10 parts of sodium sulfate. This is followed by dyeing at 120° C. for 40 min, after which the dyeing liquor is cooled down to 60° C. Then the usual afterwash is carried out. The result is a rub-fast, level, solid red dyeing which is free of any deterioration in the quality of the wool.

Using instead of the aqueous preparation of Example 1

(a) 1.3 parts of the product of Example 2, (b) 1.4 parts of the product of Example 3, (c) 1.4 parts of the product of Example 4, (d) 1.6 parts of the product of Example 5, (e) 1.4 parts of the product of Example 6, (f) 1.3 parts of the product of Example 7, (g) 1.3 parts of the product of Example 8, (h) 1.8 parts of the product of Example 9, (i) 1.4 parts of the product of Example 10 likewise gives dyeings which have good properties and are free of any adverse effect on the quality of the wool.

EXAMPLE 12

100 parts of a wool fabric weighing 180 g/m$^2$ are treated in 1000 parts of an aqueous liquor containing 4 parts of ammonium sulfate, 1.5 parts of the product of Example 1 and 0.5 part of a naphthalenesulfonic acid condensation product at 50° C. for 10 min; the pH of the liquor is first adjusted to about 6 with acetic acid. Then 3 parts of the dye of the formula

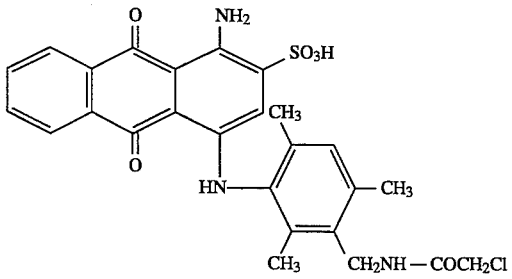

are added and the treatment is continued for a further 5 min. The dyeing liquor is then heated over about 45 min to 98° C. and the fabric is dyed at that temperature for 60 min. This is followed by cooling down to about 60° C., a customary rinse and drying of the dyed fabric. The result is a rub-fast, level blue dyeing free of any adverse effect on the quality of the wool.

Using instead of the aqueous preparation of Example 1

(a) 1.3 parts of the product of Example 2, (b) 1.4 parts of the product of Example 3, (c) 1.4 parts of the product of Example 4, (d) 1.6 parts of the product of Example 5, (e) 1.4 parts of the product of Example 6, (f) 1.3 parts of the product of Example 7, (g) 1.3 parts of the product of Example 8, (h) 1.8 parts of the product of Example 9, (i) 1.4 parts of the product of Example 10 likewise gives dyeings which have good properties and are free of any adverse effect on the quality of the wool.

EXAMPLE 13

10 parts each of wool fabric and of a bleached polyester fabric are pretreated together for 5 minutes at 40° C. in 200 parts of a liquor, adjusted with acetic acid at pH 5.5, containing 0.6 part of the product of Example 1 and 0.4 part of sodium acetate. The liquor is then heated over 30 min to 120° C., the fabric is treated at that temperature for 40 min, and the liquor is then cooled down to 60° C. After this blank treatment (without dye) the wool fabric shows no sign of loss of quality, for example in respect of the burst resistance; nor does the adjacent polyester fabric show any sign of yellowing due to hydrolyric degradation of wool.

Similar effects concerning the burst resistance of wool and the nonyellowing of the polyester fabric are obtained on using instead of the product of Example 1

(a) 0.55 part of the product of Example 2, (b) 0.60 part of the product of Example 3, (c) 0.60 part of the product of Example 4, (d) 0.65 part of the product of Example 5, (e) 0.60 part of the product of Example 6, (f) 0.55 part of the product of Example 7, (g) 0.55 part of the product of Example 8, (h) 0.75 part of the product of Example 9, (i) 0.55 part of the product of Example 10.

What is claimed is:

1. A process for dyeing a fibrous material made of or containing wool with an anionic dye, which comprises applying the anionic dye to the fibrous material in the presence of an effective fiber damage reducing amount of a wool preservative comprising at least one ether of the formula $$R—O—CH_2—CH(OH)—CH_2—Y \quad (1),$$

where Y is halogen and R is (a) the radical of a hydroxyl-containing ethylenically unsaturated compound, (b) the radical of a homo- or copolymer of hydroxyl-containing ethylenically unsaturated monomers with or without one or more comonomers, (c) the radical of a mono-, di-, tri-, oligo- or polysaccharide, (d) the radical of a monohydric $C_1$–$C_{22}$alkanol, ethylene glycol, propylene glycol or a polyhydric alcohol selected from the group consisting of glycerol, 1,1,1-tris(hydroxymethyl)propane, erythritol, pentaerythritol, arabitol, sorbitol and mannitol, (e) the radical of a polyglycerol derivative having a molecular weight ≦50,000, or (f) the radical of a polyglycol of the formula $$—(CH_2CH_2O)_s—(CH_2CH[CH_3]O)_t—H \quad (6),$$

where s and t are each independently of the other a number from 0 to 200 and the sum (s+t) is >1.

2. A process according to claim 1, wherein Y is chlorine.

3. A process according to claim 1, wherein the radical R contains one or more hydroxyl groups or gradicals of the formula $$—O13\ CH_2—CH(OH)—CH_2—Y \quad (2),$$

$$—O—(CH_2CH_2O)_x—H \quad (3)$$

$$—I—(CH_2CH[CH_3]O)_y—H \quad (4)$$

or $$—O—(CH_2CH[OH]CH_2O)_z—H \quad (5),$$

where x, y and z are each independently of the others from 1 to 20.

4. A process according to claim 1, wherein R is the radical of allyl alcohol, hydroxypropyl or hydroxyethyl acrylate, hydroxypropyl or hydroxyethyl methacrylate or dihydroxypropyl or dihydroxyethyl maleate.

5. A process according to claim 1, wherein R is the radical of arabinose, xylose, ribose, glucose, mannose, galactose, fructose, sucrose, lactose, maltose, raffinose, cellulose or starch.

6. A process according to claim 1, wherein the anionic dye is applied to a wool-polyester fibre blend material by the exhaust method.

7. A process according to claim 1, wherein R is the radical of glycerol, diglycerol, triglycerol, 1,1,1-tris(hydroxymethyl)propane, erythfitol, pentaerythfitol, arabitol, sorbitol or mannitol.

8. A process according to claim 1, wherein R is the radical of a polyglycerol having a molecular weight $\leqq 5000$.

9. A process according to claim 1, wherein R is the radical of polyethylene glycol having a molecular weight $\leqq 1000$.

10. A process according to claim 1, wherein the anionic dye is applied to the fibrous material made of or containing wool in the presence of 0.5 to 10% by weight, on weight of fibre, of one or more compounds of the formula (1).

11. A process according to claim 1, wherein the anidnic dye is applied to the fibrous material made of or containing wool in the presence of a wool preservative comprising one or more compounds of the formula (1) and an organic mono-, di- or tricarboxylic acid or a mineral acid.

* * * * *